US005467715A

United States Patent [19]

Taylor et al.

[11] Patent Number: 5,467,715

[45] Date of Patent: Nov. 21, 1995

[54] GAS GENERANT COMPOSITIONS

[75] Inventors: Robert D. Taylor, Hyrum; Thomas M. Deppert; Michael W. Barnes, both of Brigham City, all of Utah

[73] Assignee: Morton International, Inc., Chicago, Ill.

[21] Appl. No.: 207,922

[22] Filed: Mar. 8, 1994

Related U.S. Application Data

[63] Continuation-in-part of Ser. No. 165,133, Dec. 10, 1993, abandoned.

[51] Int. Cl.[6] ..... C06B 45/00

[52] U.S. Cl. ..... 102/289; 102/290; 86/1.1

[58] Field of Search ..... 102/289, 290; 86/1.1

[56] References Cited

U.S. PATENT DOCUMENTS

| | | | |
|---|---|---|---|
| 4,369,079 | 1/1983 | Shaw | 149/2 X |
| 4,370,181 | 1/1983 | Lundstrom et al. | 149/2 X |
| 4,758,287 | 7/1988 | Pietz | 149/2 X |
| 4,909,549 | 3/1990 | Poole et al. | 149/2 X |
| 4,931,112 | 6/1990 | Wardle et al. | 149/88 |
| 4,948,439 | 8/1990 | Poole et al. | 149/61 X |
| 5,035,757 | 7/1991 | Poole | 149/46 |
| 5,084,218 | 1/1992 | Vos et al. | 264/3.4 |
| 5,139,588 | 8/1992 | Poole | 149/61 X |
| 5,197,758 | 3/1993 | Lund et al. | 149/61 X |

FOREIGN PATENT DOCUMENTS 0519485 12/1992 European Pat. Off. .

*Primary Examiner*—Peter A. Nelson
*Attorney, Agent, or Firm*—Wayne E. Nacker; Gerald K. White

[57] ABSTRACT

A gas generant composition contains as a fuel a mixture of a major portion of a triazole or tetrazole and a minor portion of a water soluble fuel; and an oxidizer component, at least 20 wt % of said oxidizer component being a transition metal oxide, such as CuO.

20 Claims, No Drawings

GAS GENERANT COMPOSITIONS

This is a continuation-in-part of U.S. application Ser. No. 08/165,133 filed 10 Dec. 1993, and now abandoned.

The present Invention is directed to gas generant compositions for inflating automotive air-bags and other devices in which rapid production of high volumes of gas is required. More particularly, the invention is directed to such compositions where tetrazoles and triazoles are the fuel component and oxidizers are selected to achieve a low combustion temperature so as to minimize production of toxic oxides during combustion.

BACKGROUND OF THE INVENTION

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for unfired gas generators, there is a desire to develop non-azide gas generant systems, and a number of non-azide formulations have been proposed. However, to date, non-azide gas generants have not made significant commercial inroads.

Alternatives to azides which have been proposed, e.g., in U.S. Pat. No. 5,035,757, the teachings of which are incorporated herein by reference, include azole compounds, including tetrazole and triazole compounds. Tetrazole compounds include 5-amino tetrazole (AT), tetrazole, bitetrazole and metal salts of these compounds. Triazole compounds include 1,2,4-triazole-5-one, 3-nitro 1,2,4-triazole-5-one and metal salts of these compounds. Although all of the above azole compounds are useful fuels in accordance with the present invention, AT is the most commercially important of these.

Gas generant systems include, in addition to the fuel component, an oxidizer. Proposed oxidizers for use in conjunction with azole fuels include alkali and alkaline earth metal salts of nitrates, chlorates and perchlorates. A problem with azole compound-based gas generant systems, heretofore proposed, is their high combustion temperatures. Generated levels of toxic oxides, particularly CO and $NO_x$ depend upon the combustion temperature of the gas-generating reaction, higher levels of these toxic gases being produced at higher temperatures. Accordingly, it is desirable to produce gas generant mixtures which burn at lower temperatures.

Several gas generant processing procedures utilize water. Water-processing reduces hazards of processing gas generant materials. It is therefore desirable that gas generant compositions be formulated so as to facilitate water processing.

One Example of water processing, taught, e.g., in U.S. Pat. No. 5,015,309, the teachings of which are incorporated by reference, involves the steps of 1. Forming a slurry of the generant ingredients with water.
2. Spray drying the slurry to form spherical prills of diameter 100–300 microns.
3. Feeding the prills via gravity flow to a high speed rotary press.

In order to properly feed the tablet press, one needs well formed spherical prills. Without prills, plugging or bridging in the feed system is a common occurrence. Without prills, it is difficult to achieve uniform, high speed filling of the tablet press. These prills will not form in the spray drying step without at least a portion of the generant being water soluble. Typical slurries contain up to 35% water and it is preferred that at least 15% of the solid ingredients need to be soluble in the slurry.

Another common production technique, (e.g. U.S. Pat. No. 5,084,218), the teachings of which are incorporated herein by reference, involves the following steps:

1. Forming a slurry of the generant ingredients with water.
2. Extruding the slurry to form spaghetti like strands.
3. Chopping and spheronizing the strands into prills.
4. Tableting of the prills as described previously.

The chopping and spheronizing step to form prills will not be successful unless a portion of the generant is water soluble.

SUMMARY OF THE INVENTION

Gas generant compositions comprise between about 20 and about 40 wt % of a fuel and between about 20 and about 80 wt % of an oxidizer; balance, option additional components. Between about 50 and about 85 wt % of the fuel is a triazole or tetrazole, between about 15 and about 50 wt % of the fuel is a water-soluble fuel such as guanidine nitrate, ethylene diamine dinitrate or similar compounds. At least about 20 wt % of the oxidizer up to 100%, preferably at least about 50 wt %, comprises a transition metal oxide; balance alkali and/or alkaline earth metal nitrates, chlorates or perchlorates. The use of transition metal oxides as a major oxidizer component results in lower combustion temperatures, resulting in lower production of toxic oxides.

DETAILED DESCRIPTION OF CERTAIN PREFERRED EMBODIMENTS

Herein, unless otherwise stated, all percentages herein are by weight.

While the major fuel component may be selected from any of the tetrazole and triazole compounds listed above and mixtures thereof, from an availability and cost standpoint, 5-aminotetrazole (AT) is presently the azole compound of choice, and the invention will be described herein primarily in reference to AT. The purpose of the fuel is to produce carbon dioxide, water and nitrogen gases when burned with an appropriate oxidizer or oxidizer combination. The gases so produced are used to inflate an automobile gas bag or other such device. By way of example, AT is combusted to produce carbon dioxide, water and nitrogen according to the following equation:

$$2CH_3N_5+7/2O_2 \rightarrow 2CO_2+3H_2O+5N_2.$$

To facilitate processing in conjunction with water, a minor portion of the fuel, i.e., between about 15 and about 50 wt % of the fuel, is water soluble. While water-soluble oxidizers, such as strontium nitrate also facilitate water-processing, over-reliance on such water-soluble oxidizers tend to produce undesirably high combustion temperatures. Specific desirable characteristics of water soluble fuels are:

The compound should be readily soluble in water, i.e., at least about 30 gm/100 ml. $H_2O$ at 25° C.;

The compound should contain only elements selected from H, C, O and N;

When formulated with an oxidizer to stoichiometrically yield carbon dioxide, nitrogen, and water, the gas yield should be greater than about 1.8 moles of gas per 100 grams of formulation; and When formulated with an oxidizer to stoichiometrically yield carbon dioxide, water and nitrogen, the theoretical chamber temperature at 1000 psi should be low, preferably, less than about 1800° K.

Compounds that most ideally fit the above criteria are nitrate salts of amines or substituted amines. Suitable compounds include, but are not limited to, the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures of such compounds. Guanadine nitrate is the currently preferred water-soluble fuel.

Generally any transition metal oxide will serve as an oxidizer. Particularly suitable transition metal oxides include ferric oxide and cupric oxide. The preferred transition metal oxide is cupric oxide which, upon combustion of the gas generant, produces copper metal as a slag component. The purpose of the oxidizer is to provide the oxygen necessary to oxidize the fuel; for example, CuO oxidizes AT according to the following equation:

$$4CH_3N_5+14CuO \rightarrow 14Cu+4CO_2+6H_2O+10N_2.$$

The transition metal oxide may comprise the sole oxidizer or it may be used in conjunction with other oxidizers including alkali and alkaline earth metal nitrates, chlorates and perchlorates and mixtures of such oxidizers. Of these, nitrates (alkali and/or alkaline earth metal salts) are preferred. Nitrate oxidizers increase gas output slightly. Alkali metal nitrates are particularly useful as ignition promoting additives.

It is frequently desirable to pelletize the gas generant composition. If so, up to about 5 wt %, typically 0.2–5 wt % of a pressing aid or binder may be employed. These may be selected from materials known to be useful for this purpose, including molybdenum disulfide, polycarbonate, graphite, Viton, nitrocellulose, polysaccharides, polyvinylpyrrolidone, sodium silicate, calcium stearate, magnesium stearate, zinc stearate, talc, mica minerals, bentonite, montmorillonite and others known to those skilled in the art. A preferred pressing aid/binder is molybdenum disulfide. If molybdenum disulfide is used, it is preferred that an alkali metal nitrate be included as a portion of the oxidizer. Alkali metal nitrate in the presence of molybdenum disulfide results in the formation of alkali metal sulfate, rather than toxic sulfur species. Accordingly, if molybdenum disulfide is used, alkali metal nitrate is used as a portion of the oxidizer in an amount sufficient to convert substantially all of the sulfur component of the molybdenum disulfide to alkali metal sulfate. This amount is at least the stoichiometric equivalent of the molybdenum disulfide, but is typically several time the stoichiometric equivalent. On a weight basis, an alkali metal nitrate is typically used at between about 3 and about 5 times the weight of molybdenum disulfide used.

The gas generant composition may optionally contain a catalyst up to about 3 wt %, typically between about 1 and about 2 wt %. Boron hydrides and iron ferricyanide are such combustion catalysts. Certain transition metal oxides, such as copper chromate, chromium oxide and manganese oxide, in addition to the oxidizer function, further act to catalyze combustion.

To further reduce reaction temperature, coolants may also optionally be included at up to about 10 wt %, typically between about 1 and about 5 wt %. Suitable coolants include graphite, alumina, silica, metal carbonate salts, transition metals and mixtures thereof. The coolants may be in particulate form, although if available, fiber form is preferred, e.g., graphite, alumina and alumina/silica fibers.

The invention will now be described in greater detail by way of specific examples.

EXAMPLE 1–3

Gas generant compositions are formulated according to the table below (amounts in parts by weight, excluding molybdenum sulfide binder). The compositions were prepared by mixing the components in an aqueous slurry (approximately 70% solids), drying the composition, and screening the dried mixture. Burn rate slugs were pressed and burning rate measured at 1000 psi.

| | 1 | 2 | 3 | |
|---|---|---|---|---|
| Guanidine nitrate | 9.84 | 10.84 | 11.82 | Soluble Fuel |
| Cupric oxide | 70.94 | 70.48 | 70.03 | Oxidizer |
| 5-Aminotetrazole | 17.73 | 17.20 | 16.67 | Fuel |
| Sodium nitrate | 1.48 | 1.48 | 1.48 | Oxidizer (low ignition temperature) |
| Molybdenum disulfide | 0.5 | 0.5 | 0.5 | |

The following are properties of the compositions:

| | 1 | 2 | 3 |
|---|---|---|---|
| Burning rate at 1000 psi (ips) | 0.78 | 0.79 | 0.79 |
| Chamber Temp. (°K.) | 1653 | 1651 | 1648 |
| % Soluble (30% Slurry) | 19.6 | 21.0 | 22.4 |
| Slag | well formed (all compositions) | | |

What is claimed is:

1. A gas generant composition comprising between about 20 and about 40 wt % of fuel, said fuel comprising a tetrazole and/or triazole compound at between about 50 and about 85 wt % of said fuel and a water-soluble fuel at between about 15 and about 50 wt % of said fuel; between about 20 and about 80 wt % of oxidizer, at least about 20 wt % and up to 100% of said oxidizer being a transition metal oxide or mixture of transition metal oxides, the balance of said oxidizer being an alkali and/or alkaline earth metal nitrate, chlorate, perchlorate or mixture thereof; and, any balance comprising additional gas generant-compatible components.

2. A composition in accordance with claim 1 further comprising between about 0.2 and about 5 wt % of a binder material.

3. A composition in accordance with claim 2 wherein said binder material is molybdenum sulfide.

4. A composition in accordance with claim 3 wherein said oxidizer contains sufficient alkali metal nitrate to convert substantially all of the sulfur component of said molybdenum sulfide to alkali metal sulfate upon combustion of said gas generant composition.

5. A composition in accordance with claim 1 wherein said transition metal oxide is CuO.

6. A composition in accordance with claim 1 wherein in addition to said transition metal oxide, said oxidizer includes an alkali and/or alkaline earth metal nitrate.

7. A composition in accordance with claim 1 wherein said water soluble fuel is selected from the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures thereof.

8. A composition in accordance with claim 7 wherein said water soluble fuel is guanidine nitrate.

9. A gas generant composition comprising between about 20 and about 40 wt % of fuel, said fuel comprising a tetrazole and/or triazole compound selected from the group consisting of 5-amino tetrazole, tetrazole, bitetrazole, 1,2,4-triazole-5-one, and 3-nitro 1,2,4-triazole-5-one, said tetrazole and/or triazole compound comprising between about 50 and about 85 wt % of said fuel; and a water-soluble fuel at between about 15 and about 50 wt % of said fuel; between about 20 and about 80 wt % of oxidizer, at least about 20 wt % and up to 100% of said oxidizer being a transition metal oxide or mixture of transition metal oxides, the balance of said oxidizer being an alkali and/or alkaline earth metal nitrate, chlorate, perchlorate or mixture thereof; and, any balance comprising additional gas generant-compatible components.

10. A composition in accordance with claim 9 further comprising between about 0.2 and about 5 wt % of a binder material.

11. A composition in accordance with claim 9 wherein said transition metal oxide is CuO.

12. A composition in accordance with claim 9 wherein in addition to said transition metal oxide, said oxidizer includes an alkali and/or alkaline earth metal nitrate.

13. A composition in accordance with claim 9 wherein said water soluble fuel is selected from the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures thereof.

14. A composition in accordance with claim 9 wherein said water soluble fuel is guanidine nitrate.

15. A gas generant composition comprising between about 20 and about 40 wt % of fuel, said fuel comprising 5-amino tetrazole at between about 50 and about 85 wt % of said fuel and a water-soluble fuel at between about 15 and about 50 wt % of said fuel; between about 20 and about 80 wt % of oxidizer, at least about 20 wt % and up to 100% of said oxidizer being a transition metal oxide or mixture of transition metal oxides, the balance of said oxidizer being an alkali and/or alkaline earth metal nitrate, chlorate, perchlorate or mixture thereof; and, any balance comprising additional gas generant-compatible components.

16. A composition in accordance with claim 15 further comprising between about 0.2 and about 5 wt % of a binder material.

17. A composition in accordance with claim 15 wherein said transition metal oxide is CuO.

18. A composition in accordance with claim 15 wherein in addition to said transition metal oxide, said oxidizer includes an alkali and/or alkaline earth metal nitrate.

19. A composition in accordance with claim 15 wherein said water soluble fuel is selected from the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures thereof.

20. A composition in accordance with claim 15 wherein said water soluble fuel is guanidine nitrate.

* * * * *